US009248667B2

(12) United States Patent
Biglari

(10) Patent No.: US 9,248,667 B2
(45) Date of Patent: Feb. 2, 2016

(54) METHOD TO OPERATE AN INKJET PRINTER WITH AT LEAST TWO PRINTING STATIONS, AND INKJET PRINTER WITH TWO PRINTING STATIONS

(71) Applicant: Mehrad Biglari, Munich (DE)

(72) Inventor: Mehrad Biglari, Munich (DE)

(73) Assignee: Océ Printing Systems GmbH & CO. KG, Poing (DE)

( * ) Notice: Subject to any disclaimer, the term of this patent is extended or adjusted under 35 U.S.C. 154(b) by 0 days.

(21) Appl. No.: 14/503,507

(22) Filed: Oct. 1, 2014

(65) Prior Publication Data

US 2015/0091969 A1 Apr. 2, 2015

(30) Foreign Application Priority Data

Oct. 1, 2013 (DE) ..... 10 2013 110 904

(51) Int. Cl.

| | |
|---|---|
| ***B41J 11/00*** | (2006.01) |
| ***B41J 2/01*** | (2006.01) |
| ***B41J 13/00*** | (2006.01) |
| ***B41J 3/60*** | (2006.01) |
| ***B41J 15/04*** | (2006.01) |
| *B41J 25/304* | (2006.01) |

(52) U.S. Cl.

CPC *B41J 11/002* (2013.01); *B41J 2/01* (2013.01); *B41J 3/60* (2013.01); *B41J 13/0009* (2013.01); *B41J 15/04* (2013.01); *B41J 25/304* (2013.01)

(58) Field of Classification Search

None

See application file for complete search history.

(56) References Cited

U.S. PATENT DOCUMENTS

| | | | |
|---|---|---|---|
| 6,837,635 | B1 | 1/2005 | Juan |
| 8,302,949 | B2 | 11/2012 | Herpell et al. |
| 2010/0187745 | A1 | 7/2010 | Herpell et al. |
| 2013/0050326 | A1 | 2/2013 | Thiemann |
| 2014/0246139 | A1 | 9/2014 | Barth |

FOREIGN PATENT DOCUMENTS

| | | | |
|---|---|---|---|
| DE | 102008062365 | A1 | 7/2010 |
| DE | 102010017004 | A1 | 11/2011 |
| DE | 102012208840 | A1 | 12/2012 |
| DE | 102011054221 | A1 | 4/2013 |
| JP | 2122967 | A | 5/1990 |

*Primary Examiner* — Justin Seo

(74) *Attorney, Agent, or Firm* — Schiff Hardin LLP

(57) ABSTRACT

In a method to operate an inkjet printer with at least one first and one second printing station to print to a continuous recording medium, and wherein a drying device is provided for drying the recording medium that is printed to in the first printing station, the drying device being in a region between the first and second printing stations, after a halt of the recording medium which is equal to or greater than a predetermined duration, removing the print heads of the second printing station out of a printing position from the transport path into a park position, and after the startup only directing the print heads back again into the printing position if a segment of the recording medium that was located in a region before the drying device during the halt has passed the print heads of the second printing station.

10 Claims, 1 Drawing Sheet

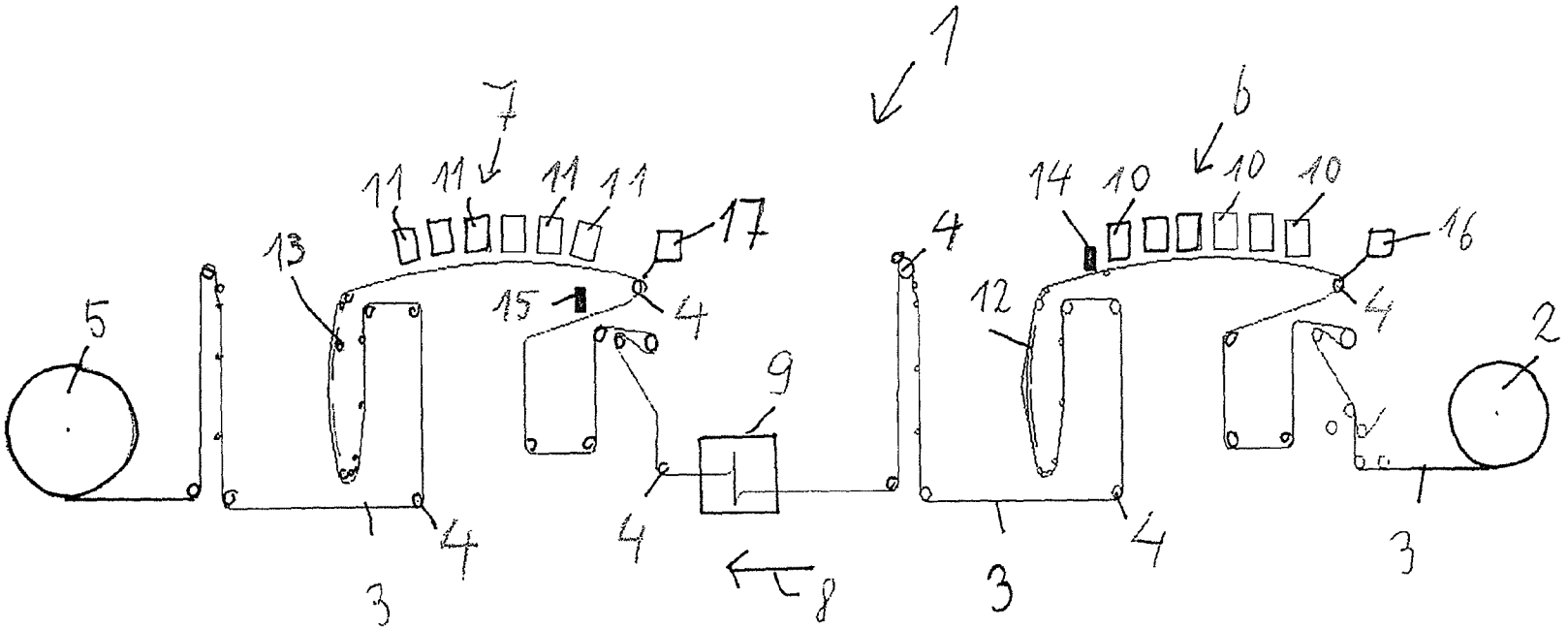
1
2
3
4
5
6
7
8
9
10
11
12
13
14
15
16
17

METHOD TO OPERATE AN INKJET PRINTER WITH AT LEAST TWO PRINTING STATIONS, AND INKJET PRINTER WITH TWO PRINTING STATIONS

BACKGROUND

The disclosure concerns a method to operate an inkjet printer with at least one first and one second printing station to print to a continuous recording medium, as well as an inkjet printer with at least one first and one second printing station to print to a continuous recording medium.

High-capacity inkjet printers to print to a continuous recording medium normally have two printing stations that are arranged along a transport path of the recording medium. The recording medium is normally a paper web. A turning device is arranged between the two printing stations so that each printing station respectively prints to one of the two sides of the recording medium.

The printing stations have multiple print heads. In the movement direction of the recording medium, a drying device respectively follows the print heads in order to dry the recording medium printed with the liquid ink. The heating power of the drying device is set such that—during normal operation, during which the recording medium is moved with continuous speed—the recording medium is dried to such an extent that the moisture introduced with the ink is removed. If the operation of the inkjet printer is interrupted, so much heat is stored in the region of the drying device and deflection rollers following the drying device that a segment of the recording medium that is located in this region is more significantly dried out than is typical.

In an unprocessed state, paper has a specific basic moisture content. Given an interruption of the printing operation, a large part of this basic moisture content can be driven out of the paper. Since, during a longer pause of the operation of the inkjet printer, the recording medium is significantly dried only in the region of the drying device and in the region following the drying region in the movement direction, and retains its moisture in the remaining regions, transition regions arise in which a segment of normal moisture content and a significantly dried segment adjoin one another. The significantly dried segments are somewhat contracted relative to the segment of normal moisture, whereby there is warping in these transition regions. This warping forms waves.

That recording media can form waves in printing systems was already previously known. The inventor of the present Patent Application has conducted many series of tests and has more closely studied the cause of the wave formation. For the first time, he was able to more specifically define the location of the wave formation, namely adjacent to the transition region between segments of normal moisture content and significantly dried segments of the recording medium or paper. The phenomenon of wave formation was not previously known at this level of precision.

According to U.S. Pat. No. 6,837,635 B1, given a wave formation of the paper in an inkjet printer it is sought to keep the waves outside of the print region so that the print heads are not damaged. For this, special rollers are used that have segments with different diameters so that additional transverse stresses are applied to the paper.

According to JP 02122967 A, folds or waves in the paper are measured by means of an ultrasonic sensor. The height of the print heads is adjusted depending on the determined height of the paper. Here it is also avoided that the print heads come into contact with the paper, whereby they may be damaged.

SUMMARY

It is an object to achieve a method to operate an inkjet printer with at least one first and one second printing station to print to a continuous recording medium, and to achieve such an inkjet printer, in which the print heads can be operated with a long service life without being damaged by a wave formation at the recording medium.

In a method to operate an inkjet printer with at least one first and one second printing station to print to a continuous recording medium, and wherein a drying device is provided for drying the recording medium that is printed to in the first printing station, the drying device being in a region between the first and second printing stations, after a halt of the recording medium which is equal to or greater than a predetermined duration, removing the print heads of the second printing station out of a printing position from the transport path into a park position, and after the startup only directing the print heads back again into the printing position if a segment of the recording medium that was located in a region before the drying device during the halt has passed the print heads of the second printing station.

BRIEF DESCRIPTION OF THE DRAWINGS

FIG. 1 schematically shows the design of an inkjet printer according to a present exemplary embodiment.

DESCRIPTION OF EXEMPLARY EMBODIMENTS

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

Given a method to operate an inkjet printer with at least one first and one second printing station to print to a continuous recording medium, the recording medium is first directed along the first printing station and subsequently along the second printing station. The printing stations have multiple print heads. In the region between the two printing stations, the recording medium printed to in the first printing station is dried with a drying device. The method is characterized in that, after a halt of the recording medium for a predetermined duration, upon startup the print heads of the second printing station are removed out of a printing position, a bit from the transport path into a park position, and are only directed back again into the printing position if the segment of the recording medium that was located in a region before the drying device during the halt has passed the print heads of the second printing station.

For the first time, the inventor of the present exemplary embodiment has exactly detected the cause of the wave formation in an inkjet printer for a continuous recording medium, and could determine the location of the wave formation (as is explained in the preceding). Due to this realization, with a very simple method it is possible to avoid a damage to the print heads of the second printing station that arise in the first printing station if the printing process is halted for a predetermined duration. No or only negligibly small waves are created given short pauses of 1 to 3 minutes. However, if the printing process is interrupted for a longer amount of time, the transition from recording medium of normal moisture content to a significantly dried recording medium is so strongly pronounced that waves that can no longer be smoothed are created in the recording medium. The furthest back (from the point of view of the second printing station) region in which waves are formed during the interruption of the print operation lies before the drying device of the first printing station in the movement direction of the recording medium. If the segment of the recording medium that was located here during the interruption of the printing operation has passed the print heads of the second printing station after resumption of the printing operation, then the print heads of the second printing station can be lowered into their printing position again without there being the danger of damage to the print heads due to waves that formed in the recording medium.

The point in time when this segment of the recording medium has passed the print heads of the second printing station can be determined by measuring the traveled path of the recording medium after startup, for example. It is also possible to print at least one synchronization marking on the recording medium after the startup in the first printing station, and to detect this synchronization marking by means of a corresponding synchronization sensor in a second printing station. In compliance with the synchronization marker detected by the synchronization sensor, the print heads can then be directed back into their printing position. Depending on where the synchronization sensor is located in the second printing station relative to the print heads, it can be appropriate to wait a predetermined duration after the detection of the synchronization marking, or to transport the recording medium by a predetermined distance before the print heads are directed back into their printing position. It can accordingly also be reasonable to begin the printing of the recording medium in the first printing system with a spatial or temporal offset relative to the printing of the synchronization marking.

An inkjet printer according to the present exemplary embodiment comprises at least one first and one second printing station to print to a continuous recording medium. Each printing station relatively has multiple print heads. A transport path to convey the recording medium is provided that first leads along the first printing station and subsequently leads along the second printing station. In the region between the two printing stations, at least one drying device is provided with which the recording medium printed to in the first printing station can be dried. The inkjet printer is characterized by a control device that is designed to execute the method explained above.

The exemplary embodiment is explained by way of an example in the following using a single drawing (FIG. 1).

The inkjet printer 1 has at its input side a feed roller 2 from which a continuous recording medium 3 is removed. The recording medium normally comprises paper. In principle, the recording medium can also be formed from a plastic film or a coated paper, in particular a paper coated with a plastic film.

A plurality of deflection rollers 4 define a transport path that leads through the entire inkjet printer 1 and ends at a take-up roller 5 at which the printed recording medium is rolled up.

The inkjet printer 1 has a first printing station 6 and a second printing station 7 that are arranged following one another in the transport direction 8. Located between the two printing stations 6, 7 is a turning device with which the recording medium is turned to its other side. This turning device 9 is typically designed as a cross turner.

The first printing station 6 has print heads 10 and the second printing station 7 has print heads 11. The print heads 10, 11 of the two printing stations 6, 7 are essentially of identical design. They respectively possess nozzles with which small ink droplets can be transferred to the recording medium. Each print head 10, 11 is connected with an ink reservoir that contains an ink of a predetermined color. Different colors are thus applied on the recording medium with the individual print heads. Normally, three print heads are provided for the three primary colors (for example cyan, magenta, yellow) and one print head is provided for black. Additional print heads can also be provided for special colors, in particular what are known as highlight colors. In the present exemplary embodiment, the three printing stations 6, 7 respectively have six print heads 10, 11. However, within the scope of the invention it is possible to provide a printing station with only a single print head for a single print color. The print heads 10, 11 are provided with a displacement mechanism (not shown) with which they are automatically moved between a printing position (in which the nozzles are spaced approximately 1 mm to 3 mm from the surface of the recording medium) and a park position (in which the nozzles are arranged 2 mm to 5 mm further distant from the surface of the recording medium, for example). The print heads can be individually displaced between the printing position and the park position.

In the printing stations 6, 7, a drying device 12, 13 respectively follows the print heads 10, 11 in the transport direction. The drying devices 12, 13 respectively have one or more heating saddles along which the recording medium 3 is directed. The heating saddles are set to a temperature of approximately 80° C. to 100° C. In operation, the deflection rollers 4 which are arranged in the region of the drying devices 12, 13 or follow the drying devices 12, 13 in the transport direction 8 also heat up.

In the transport direction 8, the first printing station 6 has after the print heads 10 an optical sensor 14 to monitor the print image printed on the recording medium. In the second printing station 7, an optical sensor 15 is provided in the intake region (thus before the print heads 11 in the transport direction 8), with which optical sensor 15 the print image printed on the recording medium 3 in the first printing station 6 is monitored.

In the printing stations 6, 7 a deflection roller 4 is respectively connected with an incremental sensor 16, 17 with which the distance traveled by the recording medium 3 is measured. Each of the incremental sensors 16, 17 generates a count pulse if the corresponding deflection roller is rotated by a predetermined angle. The count pulses are counted and are then a measure of the distance traveled. The use of such an incremental sensor for an inkjet printer is explained in detail in the German Patent Application DE 10 2010 017 004 A1.

The inkjet printer 1 has additional devices and elements (for example a housing, a central control device etc.) that are not shown in order to simplify the presentation in FIG. 1. All parameters that are relevant to operation are detected with the central control device, and the operation of the inkjet printer 1 is controlled with the control device. In particular, the central control device controls the velocity of the recording medium 3 and the printing process at the print heads 10, 11.

Given an interruption of the printing operation, the transport of the recording medium is halted. If the interruption lasts longer, i.e. longer than one to three minutes, this then leads to the situation that the recording medium is significantly heated and dried (in particular if the recording medium is paper) in the region of the drying devices 12, 13 and at the deflection rollers 4 that are heated during the operation, such that the recording medium loses the basic moisture content with which it is delivered to the feed roller 2. Such a significantly dried recording medium shrinks. This shrinkage generates warping, primarily in the region that adjoins a region with normal moisture content of the recording medium. The warping leads to the formation of waves in the recording medium that result from the transition region between a dry segment and a segment of normal moisture content. Given conventional inkjet printers with two printing stations, this leads to the situation that—after a longer interruption of the printing operation—a segment of the recording medium that has waves is conveyed into the second printing station. These waves drag or grind on the print heads and can clog or destroy the nozzles of said print head. The print heads are very complicated, fine mechanical components that incur significant costs. Inkjet print heads for high-capacity systems for a single printing station cost approximately EUR 50,000 at current market prices.

Therefore, a differentiation is made between short pauses in which the printing operation is halted for such a short amount of time that no waves are generated and interruptions in which the printing operation is halted for so long that there exists the danger of wave formation. The threshold between pauses and interruptions lies in the range of one to three minutes, and depends on the type of recording medium that is used and the heating device or the temperature at which the heating device is operated.

During an interruption, the print heads 11 of the second printing station 7 are raised from the printing position into the park position, and thus are moved a bit away from the recording medium 3.

After an interruption, the movement of the recording medium 3 is resumed and the recording medium is moved in the transport direction 8. If the segment of the recording medium 3 that was arranged in the region before the drying device 12 of the first printing station 6 during the interruption has passed the print heads 11 of the second printing station 7, then the print heads 11 of the second printing station are moved from the park position into the printing position again. The segment of the recording medium that was located in the region before the drying device 12 during the interruption is that segment in which waves can be formed, and that is furthest distant from the second printing station. If this segment is moved past the print heads 11 of the second printing station 7, it is then ensured that no wavy segments of the recording medium 3 are supplied to the second printing station.

There are multiple possibilities to establish whether the recording medium has traveled this required distance or not.

1. After an interruption, the print heads 11 of the second printing station 7 are only moved from the park position into the printing position again after a preset time (thus with a temporal offset). This is the simplest solution.
2. The predetermined path length that the recording medium must travel so that the potential selected segment has reliably passed the print heads 11 of the second printing station 7 is measured with one of the two incremental sensors 16, 17. However, this solution is conditional on the path between the first printing station and the second printing station being exactly known and established.
3. After the interruption, in the first printing station a synchronization marker is printed on the recording medium. This synchronization marker has a defined spacing from the potentially selected segment of the recording medium. This spacing can be caused by the structural arrangement of the print head with which the synchronization marker has been applied. However, this spacing can also be generated by movements of the recording medium in the transport direction 8 by a predetermined distance that, for example, is measured with the incremental sensor 16, and therefore a printing of the synchronization marking that is temporally offset relative to the beginning of the resumption of the movement of the recording medium can be generated. In the second printing station, the synchronization marking is detected by the optical sensor 15 that acts as a synchronization sensor. As soon as the synchronization sensor has detected the synchronization marking, the print heads 11 of the second printing station 7 are moved from their park position into the printing position. However, it can also be appropriate to execute the movement of the print heads with a temporal offset relative to the detection of the synchronization marking, wherein the point in time is advantageously determined by measuring a predetermined distance by means of the incremental sensor 17 of the second printing station. The use of a synchronization marking offers the advantage that the lengths of the transport path between the first and second printing station do not need to be established exactly. High-capacity inkjet printers are often of modular design, wherein they are assembled from different components such that—even given use of similar printing stations—different paths can result between the printing stations in different inkjet printers.

In the present exemplary embodiment, the travel path from the printing position to the park position is 4 mm. The travel time lasts approximately 2 seconds. The transport velocity of the recording medium amounts to approximately 2.1 m/s, such that more than 4 m of recording medium can be conveyed during the travel time. Without a movement of the print heads, the beginning of printing could already start after a movement of approximately 2 m of the recording medium. An additional spoilage of approximately more than 2 m is thus caused by the method according to the exemplary embodiment. However, this spoilage is accepted in light of the significant costs that a damage to the print heads can incur.

The entire method is controlled wholly automatically by means of the control device.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A method to operate an inkjet printer with at least one first and one second printing station to print to a continuous recording medium, comprising the steps of:

providing the respective printing stations with at least multiple print heads and providing the recording medium directed first along the first printing station and subsequently along the second printing station;

also providing a drying device and drying the recording medium that is printed to in the first printing station with the drying device in a region between the first and second printing stations;

after a halt of the recording medium which is equal to or greater than a predetermined duration, removing the print heads of the second printing station out of a printing position from the transport path into a park position; and after resuming conveyance of the recording medium, only directing the print heads back again into the printing position if a segment of the recording medium that was located in a region before the drying device during the halt has passed the print heads of the second printing station.

2. The method according to claim 1 wherein upon the resuming conveyance of the recording medium, the distance traveled by the recording medium is measured, and the print heads of the second printing station are directed back again into the printing position after the recording medium has traveled a predetermined distance.

3. The method according to claim 1 wherein after the halt of the recording medium, the first printing station prints at least one synchronization marking on the recording medium, the recording medium is monitored with regard to said synchronization marking with a synchronization sensor that is arranged in the second printing station, and the print heads are directed back into their printing position in compliance with the synchronization marking that is detected by the synchronization sensor.

4. The method according to claim 3 wherein after the detection of the synchronization marking, a predetermined time is waited or the recording medium is transported by a predetermined distance before the print heads are directed back into their printing position.

5. The method according to claim 1 wherein the print heads of the second printing station are directed back into the printing position with a temporal offset.

6. The method according to claim 1 wherein the distance between the printing position and the park position is at least 2 mm.

7. The method according to claim 1 wherein the predetermined duration of the halt of the recording medium is at least 1 min.

8. The method according to claim 1 wherein the print heads are directed back again into the printing position after a preset time after said halt of the recording medium.

9. The method according to claim 1 wherein said predetermined duration is determined based on when a predetermined undesirable wave formation would occur in the recording medium at a transition between an excessively dried region dried by the drying device during a halt of the recording medium as compared to an adjacent region not excessively dried by the drying device.

10. A method to operate an inkjet printer with at least one first and one second printing station to print to a continuous recording medium, comprising the steps of:

providing the respective printing stations with at least multiple print heads and providing the recording medium directed first along the first printing station and subsequently along the second printing station;

also providing a drying device and drying the recording medium that is printed to in the first printing station with the drying device in a region between the first and second printing stations;

after a halt of the recording medium which is equal to or greater than a predetermined duration, removing the print heads of the second printing station out of a printing position from the transport path into a park position, said predetermined duration being dependent upon when an unacceptable wave formation would be created in the recording medium based on exposure of a portion of the recording medium to the drying device during the halt; and after resuming conveyance of the recording medium, only directing the print heads back again into the printing position if a segment of the recording medium that was located in a region before the drying device during the halt has passed the print heads of the second printing station.

* * * * *